US006842143B2

(12) United States Patent
Otaka et al.

(10) Patent No.: US 6,842,143 B2
(45) Date of Patent: Jan. 11, 2005

(54) MULTIPLE BAND ANTENNA

(75) Inventors: Naoki Otaka, Komaki (JP); Noriyasu Sugimoto, Konan (JP); Toshikatsu Takada, Konan (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 10/446,163

(22) Filed: May 28, 2003

(65) Prior Publication Data

US 2004/0104850 A1 Jun. 3, 2004

(30) Foreign Application Priority Data

Dec. 3, 2002 (JP) ..... 2002-350735

(51) Int. Cl.[7] ..... H01Q 1/38; H01Q 1/36
(52) U.S. Cl. ..... 343/700 MS; 343/895
(58) Field of Search ..... 343/700 MS, 702, 343/895

(56) References Cited

U.S. PATENT DOCUMENTS 6,329,962 B2 12/2001 Ying ..... 343/895
6,351,241 B1 2/2002 Wass ..... 343/702
6,452,548 B2 * 9/2002 Nagumo et al. ..... 343/700 MS
6,674,405 B2 * 1/2004 Wang ..... 343/700 MS
6,677,907 B2 * 1/2004 Shoji et al. ..... 343/702

FOREIGN PATENT DOCUMENTS

WO WO 01/13464 A1 2/2001
WO WO 02/39542 A1 5/2002

* cited by examiner

*Primary Examiner*—Hoang V. Nguyen
(74) *Attorney, Agent, or Firm*—Stites & Harbison PLLC; Ross F. Hunt, Jr.

(57) ABSTRACT

A multiple band antenna comprising: a dielectric substrate; and a plurality of conductor parts formed on a face of the dielectric substrate and connected to each other, wherein the plurality of conductor parts comprises: a first conductor part extending in a first direction with a repetitive pattern of peaks and valleys of a linear line and arriving at an open end; a second conductor part extending in a second direction substantially opposite to the first direction with a repetitive pattern of peaks and valleys of a linear line and arriving at an open end; and a third conductor part formed of a wide line having a wider width than that of each of the linear lines of the first and second conductor parts and connected to opposite ends of the first and second conductor parts and also connected to a feeder line.

10 Claims, 8 Drawing Sheets

MULTIPLE BAND ANTENNA

FIELD OF THE INVENTION

This invention relates to a multiple band antenna and in particular to an antenna used with a radio communication device used for a wireless LAN (local area network), a mobile telephone, Bluetooth, etc.

BACKGROUND OF THE INVENTION

Formerly, one communication device was able to communicate with another only in one frequency band. In recent years, however, a communication device that can communicate in a plurality of frequency bands has been developed. For example, in a wireless LAN, a communicating system using a 2.4-GHz band and a communicating system using a 5-GHz band are available. Also in a mobile telephone, a system using a 0.8-GHz band and a system using a 1.5-GHz band are available. Such a communication device that can communicate in a plurality of frequency bands uses a multi-band antenna capable of transmitting and receiving radio waves of a plurality of frequency bands.

Various types of multi-band antennas are available. For example, an antenna 300 shown in FIG. 9 has two antenna elements 304 and 306 made of conductors placed in parallel on a dielectric substrate 302. The antenna elements 304 and 306 are connected to two branches into which a feeder line 308 is divided at an intermediate point from a signal source (not shown). (For example, refer to a document, "Zukai idoutuushinyou antenna system" written by FUJIMOTO Kyouhei, YAMADA Yoshihide, and TUNEKAWA Kouichi, published by Sougou Denshi Shuppansha, First edition, Oct. 10, 1996)

SUMMARY OF THE INVENTION

The user has a liking for a small size of a communication device used for a mobile telephone, a wireless LAN, etc., because of portability and convenience of the device. Thus, there are demands for miniaturizing a radio communication device and by extension miniaturizing an antenna.

If a plurality of antenna elements are brought close to each other for miniaturizing an antenna as the antenna shown in FIG. 9, the characteristics of the antenna elements may be degraded because of electromagnetic interaction between the antenna elements. Specifically, between the antenna elements, electromagnetic wave flows interfere with each other and the center frequencies deviate from the intended range and the impedances deviate from the intended range, so that the gains of the antenna elements are reduced. On the other hand, if a plurality of antenna elements are placed at a distance from each other, degradation of the characteristics caused by interaction can be suppressed, but the antenna itself may be upsized.

The invention is intended for solving the above-described problems in the related arts and it is an object of the invention to miniaturize a multi-band antenna.

To the end, according to the invention, there is provided a multiple band antenna, including a dielectric substrate; and a plurality of conductor parts formed on the dielectric substrate and connected to each other, wherein the plurality of conductor parts include a first conductor part extending in a first direction with a repetitive pattern of peaks and valleys of a linear line and arriving at an open end; a second conductor part extending in a second direction substantially opposite to the first direction with a repetitive pattern of peaks and valleys of a linear line and arriving at an open end; and a third conductor part formed of a wide line having a wider width than that of each of the linear lines of the first and second conductor parts and connected to opposite ends of the first and second conductor parts and also connected to a feeder line.

In the antenna according to the invention, the first and second conductor parts are connected by the linear line having a wider width than that of the linear line of the first, second conductor part, so that the antenna can be downsized. Further, the first and second conductor parts are formed so as to extend in substantially opposite directions, so that upsizing the antenna in the perpendicular direction to the directions can be suppressed.

In the antenna, preferably a line connecting the connection position of the first and third conductor parts and the connection position of the first and third conductor parts and a line passing through the center of the peaks and valleys and extending in the first direction in the first conductor part are not parallel.

In doing so, the linear line connecting the first and second conductor parts can be used as a part of the antenna element, so that upsizing the antenna itself in the first direction can be suppressed.

In the antenna, when the point nearest to the connection position to the third conductor part, of points at which the line passing through the center of the peaks and valleys and extending in the first direction and the linear line in the first conductor part cross each other is a first base point, and when the point nearest to the connection position to the third conductor part, of points at which the line passing through the center of the peaks and valleys and extending in the second direction and the linear line in the second conductor part cross each other is a second base point, preferably a first angle between a line extending in a third direction from the second base point to the first base point and the line extending in the first direction is 90 degrees or less.

In doing so, the first and second conductor parts are formed so that they are not positioned in the perpendicular direction to the extension direction. Thus, the electromagnetic interaction between the first and second conductor parts can be decreased.

In the antenna, the dielectric substrate may be a print circuit board for mounting parts. Further, at lest part of surfaces of the plurality of conductor parts may be covered with an insulation layer. The insulation layer preferably comprises a ceramic which may be same as that of the dielectric substrate or a resin such as an epoxy resin and a phenol resin. The thickness of the insulation layer is not limited, but, preferably from 10 to 100 $\mu$m.

The invention can be embodied in various modes. For example, it can be embodied as a radio frequency module, a radio communication device, etc., including any of the antennas of the invention.

DESCRIPTION OF REFERENCE NUMERALS

Figure 1:
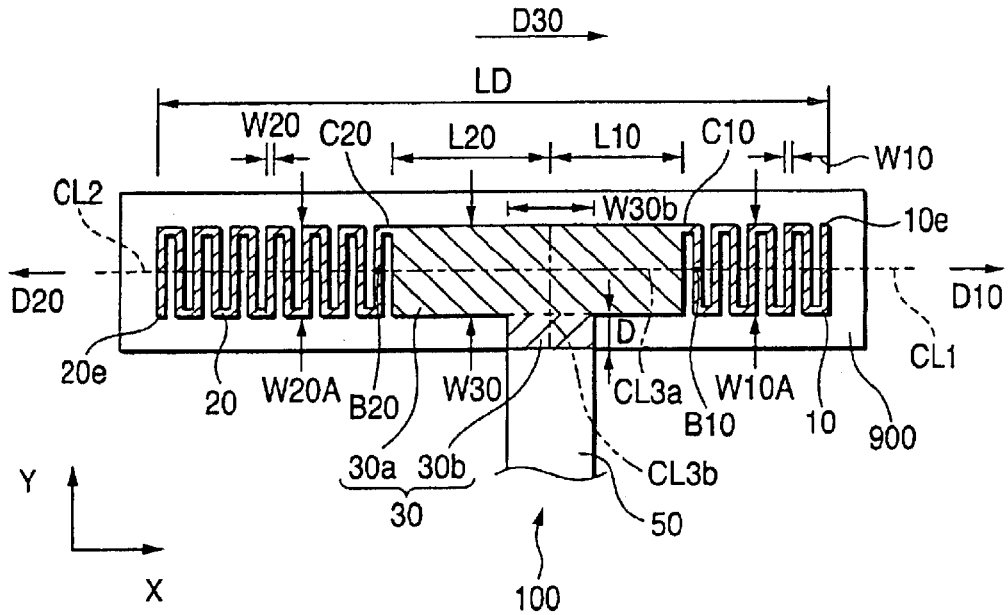
FIG. 1 is a plan view to show an antenna 100 as a first embodiment of the invention.

10–13: First conductor part
20–23: Second conductor part
30–33: Third conductor part
10*e*–13*e:* Open end
20*e*–23*e:* Open end
50: Feeder line
56, 60: Low-noise amplifier
58, 62: Power amplifier
500: Radio frequency module
900, 910, 920, 930: Dielectric substrate
72, 74: Switch
76: Diplexer
100, 110, 120, 130: Antenna
200: Single-band antenna
D10–D13: First direction
D20–D23: Second direction
D30–D33: Third direction
B10–B13: First base point
B20–B23: Second base point
C10–C13: Connection position
C20–C23: Connection position
SH: Antenna
SL: Antenna

DETAILED DESCRIPTION OF THE INVENTION

Embodiments of the invention will be discussed in the following order:
A1. First embodiment:
A2. Second embodiment:
A3. Third embodiment:
A4. Fourth embodiment:
B. Radio frequency module:
C. Modifications:
A1. First Embodiment FIG. 1 is a plan view to show an antenna 100 as a first embodiment of the invention. The antenna 100 of the embodiment is used with a radio communication device in a wireless LAN, etc., for example, and is able to operate with two frequency bands of a 2.4-GHz band and a 5-GHz band. The antenna adopts a monopole type in which the effective length of an antenna element is about one-quarter wavelength.

As shown in FIG. 1, the antenna 100 of the embodiment includes a dielectric substrate 900 formed of a dielectric preferably of ceramics such as aluminum oxide and glass ceramic, and a first conductor part 10, a second conductor part 20, and a third conductor part 30 formed of a conductor such as Ag, Ag—Pt, Ag—Pd, Cu, Au, W, Mo and Mn and an alloy of at least two of them, on the surface of the dielectric substrate 900.

The first conductor part (first meander conductor part) 10 has a linear line extending in a first direction D1 with a periodically repetitive pattern of rectangular wave shape, which will be hereinafter called meander shape, to an open end 10*e*. The wave shape may be formed by a curbed line, a straight line or a jagged line, or a combination thereof. It has an opposite end C10 connected to the third conductor part (wide conductor part) 30. The first meander conductor part 10 is fitted for transmission and reception in the 5-GHz band.

The second conductor part (second meander conductor part) 20 has a linear line extending in a second direction D2 different 180 degrees from the first direction D1 with a meander shape to an open end 20*e*. It has an opposite end C20 connected to the wide conductor part 30. The second conductor part 20 operates with the 2.4-GHz band. In the embodiment, a width W20 of the second meander conductor part 20 is the same as a width W10 of the first meander conductor part 10, but they can also be set to different values.

The wide conductor part 30 is positioned between the first and second meander conductor parts 10 and 20. The wide conductor part 30 is formed of a wide line and a width W30 of the line is wider than the width W10, W20 of the linear line of the first, second meander conductor part 10, 20. The wide conductor part 30 has a meander connection part 30*a* connected to the first and second meander conductor parts 10 and 20 and a feeder line connection part 30*b* connected to a feeder line 50, the connection parts 30*a* and 30*b* being connected roughly like the shape of a letter T. The meander connection part 30*a* extends linearly in the same direction as the direction D10, D20 of the first, second meander conductor part 10, 20. The feeder line connection part 30*b* extends in a perpendicular direction to the directions D10 and D20. In FIG. 1, the first and second meander conductor parts 10 and 20, the meander connection part 30*a,* and the feeder line connection part 30*b* are hatched in different manners, but they are formed preferably of the same material as a continuous area.

The first meander conductor part 10 functions as one antenna element together with the meander connection part 30*a* (operating with the 5-GHz band). Likewise, the second meander conductor part 20 functions as one antenna element together with the meander connection part 30*a* (operating with the 2.4-GHz band) That is, the wide conductor part 30 is shared between the two antenna elements. A part of each antenna element, namely, each of the first and second meander conductor parts 10 and 20 forms a meander shape, so that the antenna can be miniaturized.

In FIG. 1, a first base point B10 is shown in the proximity of the connection position of the first meander conductor part 10 and the wide conductor part 30. The first base point B10 is the point nearest to the connection position to the wide conductor part 30, of points at which a line CL1 passing through the center of the peaks and valleys of the first meander conductor part 10 and extending in the first direction D10 and the linear line of the first meander conductor part 10 cross each other. The first meander conductor part 10 is formed so as to pass through the first base point B10 and extend in the first direction D10. In other words, the first meander conductor part 10 is formed so that the linear line repeatedly crosses the line extending in the first direction with the first base point B10 as the start point. That is, the first base point B10 means the substantial start point of the first meander conductor part 10.

A second base point B20 is shown in the second meander conductor part 20 like the first meander conductor part 10. The second base point B20 is the point nearest to the connection position to the wide conductor part 30, of points at which a line CL2 passing through the center of the peaks and valleys of the second meander conductor part 20 and extending in the second direction D20 and the linear line of the second meander conductor part 20 cross each other. The second meander conductor part 20 is formed so as to pass through the second base point B20 and extend in the opposite direction (second direction D20) to the first direction D10. In the embodiment, the line CL1, the line CL2, and a center line CL3*a* of the meander connection part 30*a* become the same line.

In the embodiment, the first and second meander conductor parts 10 and 20 are formed so that they are arranged in opposite directions on the same line. Thus, increasing of the antenna width in the perpendicular direction to the extension direction of the first and second meander conductor parts 10 and 20 can be suppressed.

Generally, the antenna element and any other conductor positioned nearby have an electromagnetic effect on each other. In the antenna element having a meander shape, as the angle between the direction from the position of the antenna element to the position of any other conductor (for example, another antenna element or a ground conductor part) and the extension direction of the antenna element is nearer to 90 degrees, the effect of the interaction between the antenna element and the conductor becomes larger. In other words, as the direction in which the conductor is positioned is closer to the perpendicular direction to the extension direction of the antenna element when viewed from the antenna element, the characteristic of the antenna is strongly affected by the electromagnetic interaction between the antenna and the conductor. In the embodiment, the first and second meander conductor parts 10 and 20 are formed so that they are not positioned in the perpendicular direction to the extension directions of the antenna elements (first and second meander conductor parts 10 and 20), so that the electromagnetic interaction between the first and second meander conductor parts 10 and 20 can be suppressed.

In the first embodiment, the extension directions of the first and second meander conductor parts 10 and 20 are completely opposite to each other (the angle between the first and second directions is 180 degrees). However, if the extension directions are substantially opposite to each other although the angle a little deviates from 180 degrees, the electromagnetic interaction between the two meander conductor parts 10 and 20 can be lessened and upsizing of the antenna can be suppressed. However, preferably the deviation from 180 degrees is small from the viewpoint of miniaturization of the antenna. For example, preferably the angle between the first and second directions is 160 degrees or more; more preferably the angle is 170 degrees or more. When the extension direction deviates, it is preferable to deviate to an opposite direction of the feeder line.

By the way, in the antenna as the first embodiment shown in FIG. 1, the width W30 of the wide line 30*a* connecting the first and second meander conductor parts 10 and 20, of the wide conductor part 30 is larger than the width W10, W20 of the linear line of the first, second meander conductor part 10, 20. Consequently, each of the first and second meander conductor parts 10 and 20 is connected to the feeder line 50 through the linear line having the wider width W30. Here, let the distance along the center line CL3*a* of the meander connection part 30*a* from a center line CL3*b* of the feeder line connection part 30*b* to the connection position C10 of the first meander conductor part 10 and the wide conductor part 30 be L10. Let the distance along the center line CL3*a* of the meander connection part 30*a* from the center line CL3*b* of the feeder line connection part 30*b* to the connection position C20 of the second meander conductor part 20 and the wide conductor part 30 be L20. Then, the length L10, L20 is adjusted, whereby the length of the wide conductor part 30 from the connection position C10, C20 of the first, second meander conductor part 10, 20 to the feeder line 50 can be adjusted. Thus, the lengths L10 an L20 are adjusted, whereby impedance adjustments (by extension reflection coefficient adjustments) for the frequency bands with those the antenna operates can be made easily. In other words, by adjusting the lengths L10 and L20, the impedances of the conductor parts 10 and 20 can be individually adjusted to match the operating frequency of the antennas formed by conductors 10 and 20.

Figure 2A:
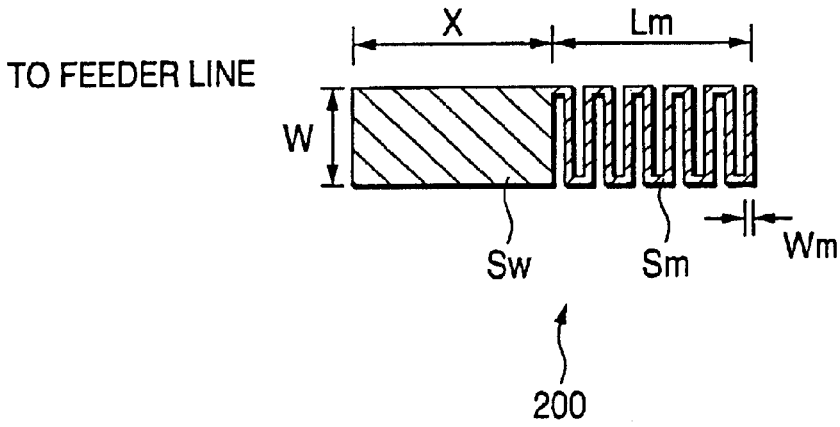
FIG. 2 (FIGS. 2A and 2B) is a schematic representation to describe reflection coefficient of single-band antenna.
Figure 2B:
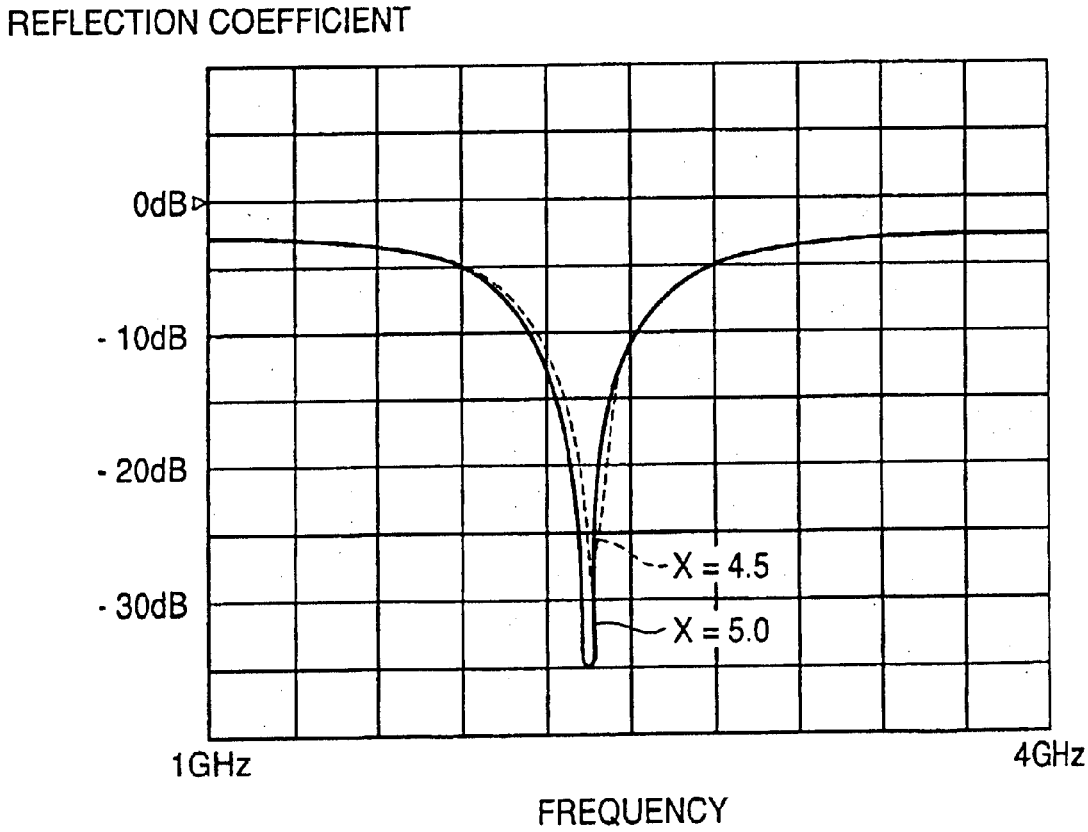

FIGS. 2A and 2B are schematic representations to show the result of an experiment conducted using a single-band antenna to examine the effect of the length of the wide conductor part 30 on the reflection coefficient of the antenna. FIG. 2A shows a single-band antenna 200. This single-band antenna 200 is made up of a wide conductor part Sw and a meander conductor part Sm. The wide conductor part Sw is a linear conductor part having a given width W and is connected at one end to a feeder line (not connected) and at an opposite end to the meander conductor part Sm. The meander conductor part Sm is connected at one end to the wide conductor part Sw and forms a meander shape extending in the same direction as the extension direction of the wide conductor part Sw and an opposite end is an open end. A width W of the wide conductor part Sw is wider than a width Wm of a linear line forming the meander shape.

FIG. 2B shows the relationship between the reflection coefficient of the single-band antenna and frequency. The vertical axis indicates the reflection coefficient of the antenna; the smaller the value, the smaller the reflection component, namely, the more efficient the antenna (in dB units) The horizontal axis indicates the frequency of a signal supplied from the feeder line. FIG. 2B shows two cases where in the single-band antenna in FIG. 2A, a length X of the wide conductor part Sw is 4.5 mm and is 5.00 mm when a length Lm of the meander conductor part Sm is 10 mm, the width Wm of the linear line is 0.25 mm, and the width of the line of the wide conductor part Sw is 2 mm.

As shown in FIG. 2B, the reflection coefficients become small in the periphery of 2.4 GHz and it is seen that the single-band antennas different in length X operate with the 2.4 GHz band. On the other hand, the minimum values of the reflection coefficient become different in response to the length X and are −30 dB and −35 dB in the example in FIG. 2B. The bandwidth fitted for transmission and reception of a signal (for example, the frequency range when the reflection coefficient is −10 dB or less) also differs in response to the length X (in the example in FIG. 2, the length X is adjusted from 4.5 mm to 5.0 mm, thereby widening the bandwidth). That is, the length X of the wide conductor part Sw is adjusted, whereby the reflection coefficient of the antenna (impedance) can be adjusted without largely changing the corresponding frequency band.

Impedance adjustment as the length of the wide conductor part is adjusted can also be made in a similar manner in the antenna as the first embodiment shown in FIG. 1. In the antenna 100 shown in FIG. 1, the first meander conductor part 10 functions as one antenna element together with the passage from the feeder line of the wide conductor part 30 to the first meander conductor part 10. Likewise, the second meander conductor part 20 functions as one antenna element together with the passage from the feeder line of the wide conductor part 30 to the second meander conductor part 20. Thus, the length L10, L20 from the connection position C10, C20 of the first, second meander conductor part 10, 20 and the wide conductor part 30 to the branch position to the feeder line is adjusted, whereby the length of the passage from the feeder line 50 to the first, second meander conductor part 10, 20 can be adjusted. That is, the length L10 is adjusted, whereby the impedance in the frequency band of a signal transmitted and received by the first meander conductor part 10, which will be hereinafter called first frequency band, can be adjusted easily. Further, the length L10 is independent of the length of the passage from the feeder line 50 of the wide conductor part 30 to the second meander conductor part 20. Consequently, the length L10 can be adjusted without largely affecting the impedance in the frequency band of a signal transmitted and received by the second meander conductor part 20, which will be hereinafter called second frequency band. For the second meander conductor part 20, likewise, the length L20 of the meander connection part 30*a* is adjusted, whereby the impedance in the second frequency band can be adjusted. Thus, impedance adjustments in the first and second frequency bands can be easily made separately. As the length of the wide conductor part (namely, L10 or L20) is adjusted, if the corresponding frequency band (frequency area with small reflection coefficient) deviates from the objective frequency band, the first, second meander conductor part 10, 20 having the corresponding meander shape is lengthened or shortened, whereby the frequency band can be adjusted.

As the width W30 of the linear line (meander connection part 30*a*) connecting the first and second meander conductor parts 10 and 20 in the width of the wide conductor part 30 is larger, the impedance can be adjusted more easily; however, preferably the width W30 is not made excessively large from the viewpoint of the size of the antenna itself. For example, preferably the width W30 is in the range of 5 to 20 times the width W10, W20 of the linear line of the first, second meander conductor part 10, 20; particularly preferably in the range of 10 to 15 times the width W10, W20 of the linear line. A width W30*b* of the feeder line connection part 30*b* may be made different from the width W30 of the meander connection part 30*a*. However, preferably the widths W30 and W30*b* are set to the same value from the point of capability of suppressing signal reflection at a width change position.

By the way, in the antenna as the first embodiment shown in FIG. 1, the wide conductor part 30 having the width W wider than the width W10, W20 of the linear line of the first, second meander conductor part 10, 20 is shared between the first and second frequency bands. Consequently, whole antenna length LD can be made smaller than the sum total of two single-band antennas for operating with the frequency bands.

Figure 3:
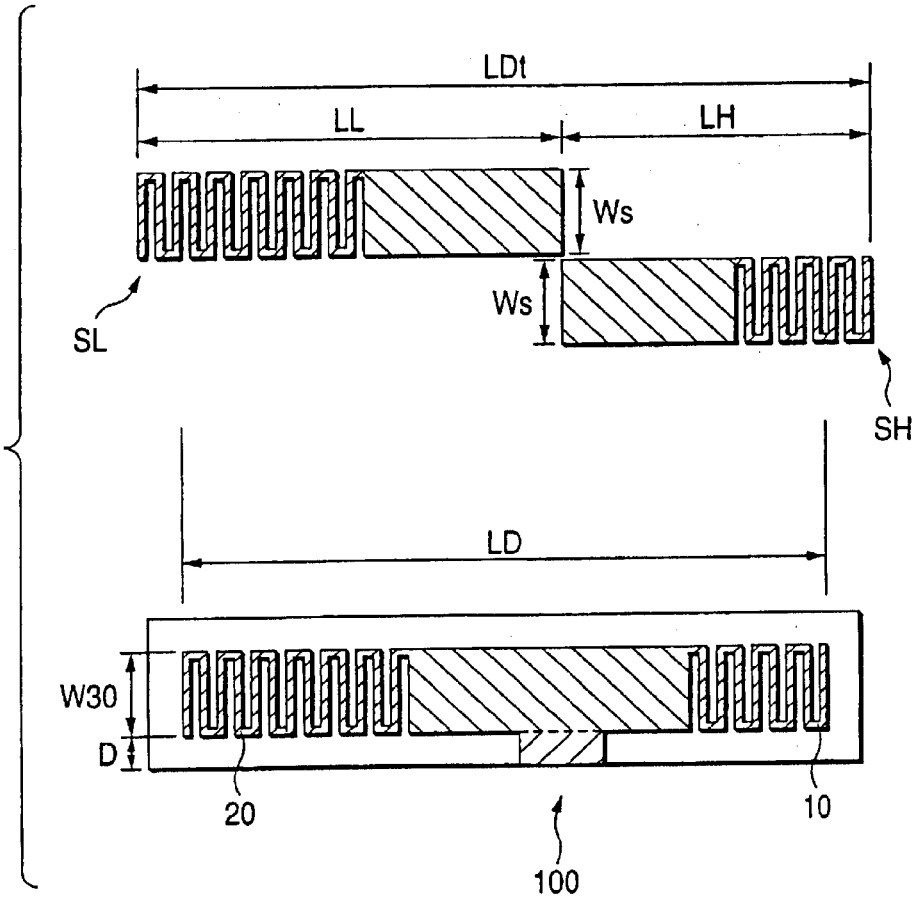
FIG. 3 is a schematic representation to show single-band antennas.

FIG. 3 is a schematic drawing to show comparison between two single-band antennas SH and SL for transmitting and receiving the same two frequency bands as the multi-band antenna 100 in FIG. 1 and the multi-band antenna 100. The first single-band antenna SH is used for the first frequency band (5-GHz band) and the second single-band antenna SL is used for the second frequency band (2.4-GHz band).

A length LH of the first antenna SH was 8 mm, a length LL of the second antenna SL was 12 mm, and a total length LDt was 20 mm. On the other hand, the length LD of the multi-band antenna 100 was 14 mm (the width W30 of the wide conductor part was made the same as a width Ws of the first, second single-band antenna SH, SL.) In the example, using the multi-band antenna 100, it was made possible to shorten the whole antenna length 30% (20 mm to 14 mm). A length D of the branch part to connect to the feeder line was 2 mm and as the length of the shared part was considered, it was made possible to shorten the whole antenna length 20% (20 mm to 16 mm).

Thus, a part of the passage from each of the first and second meander conductor parts 10 and 20 to the feeder line 50 is shared, so that the whole antenna length LD can be made smaller than the sum total TDt of the lengths of the two single-band antennas for operating with the frequency bands.

In the first embodiment, the whole widths of the first and second meander conductor parts 10 and 20, namely, widths W10A and W20A (FIG. 1) in the perpendicular direction to the extension directions of the repetitive patterns of the linear lines (first and second directions) can be set separately in response to the operated frequency bands and further can also be set independently of the width W30 of the third conductor part. However, preferably the widths W10A and W20A are set to the same value from the viewpoint of effectively using the area required for the antenna configuration.

In the antenna 100 of the first embodiment, the first, second, and third conductor parts 10, 20, and 30 can be formed on the same face of the dielectric substrate 900. Thus, the manufacturing process of the antenna 100 can be simplified as compared with the case where the conductor parts are formed on the surface, side, and back of a dielectric substrate or are formed in a dielectric substrate.

To form the first, second, and third conductor parts 10, 20, and 30 on the dielectric substrate 900, for example, a method of performing screen printing of silver paste as the shapes of the conductor parts 10, 20, and 30 on the surface of the dielectric substrate 900 and then baking at a predetermined temperature can be used.

A2. Second Embodiment

Figure 4:
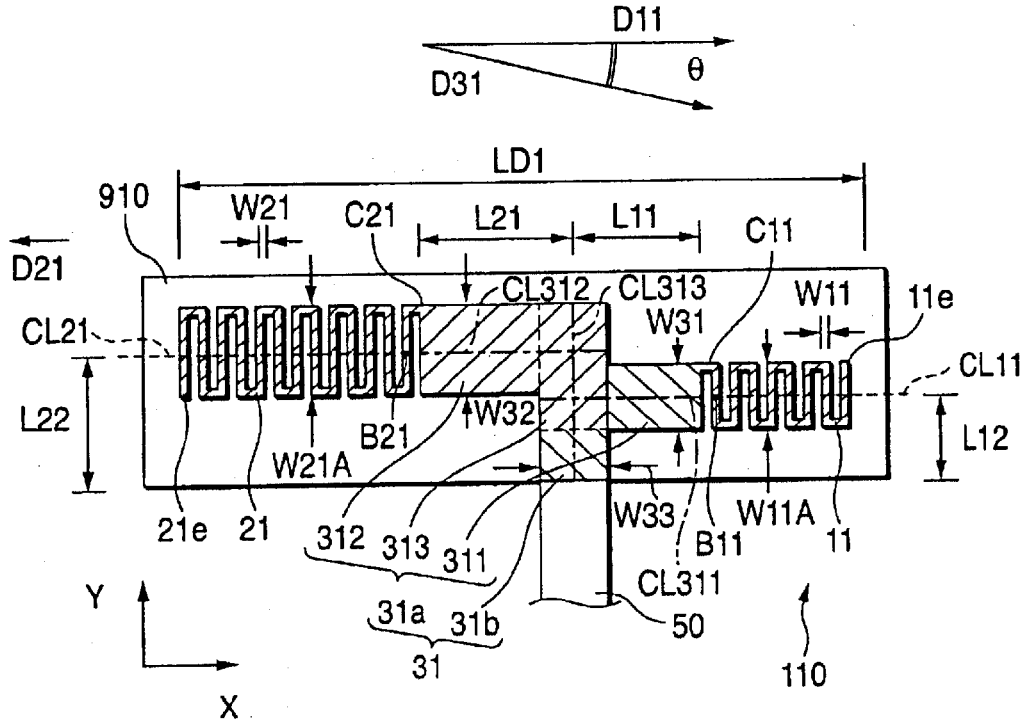
FIG. 4 is a plan view to show an antenna 110 as a second embodiment of the invention.

FIG. 4 is a plan view to show an antenna 110 as a second embodiment of the invention. The antenna 110 differs from the antenna 100 of the first embodiment previously described with reference to FIG. 1 in the following two points: First, a line connecting a connection position C11 of a first meander conductor part 11 and a wide conductor part 31 and a connection position C21 of a second meander conductor part 21 and the wide conductor part 31 is not parallel with a line CL11 passing through the center of the peaks and valleys of the first conductor part and extending in a first direction D11. That is, the two connection positions C11 and C12 deviate from each other in a perpendicular direction to the first direction D11. Second, the wide conductor part 31 has a stepwise shape, in other words, a drank shape.

The wide conductor part 31 is positioned between the first and second meander conductor parts 11 and 21. The wide conductor part 31 is made up of a meander connection part 31*a* connecting the first and second meander conductor parts 11 and 21 and a feeder line connection part 31*b* connected to a feeder line 50 The meander connection part 31*a* is formed like a crank shape and is made up of a first extension part 311, a second extension part 312, and a bend part 313 for connecting the extension parts. The first and second extension parts 311 and 312 form each one end of the meander connection part 31*a*. The bend part 313 is positioned between the first and second extension parts 311 and 312 for connecting the extension parts 311 and 312.

The first extension part 311 has a linear shape having a width W31 measured along the first direction D11 and is connected at one end to the first meander conductor part 11. The first extension part 311 and the first meander conductor part 11 are arranged on the same line. That is, a center line CL311 of the first extension part 311 and the line CL11 passing through the center of the first meander conductor part 11 become the same line.

The second extension part 312 has a linear shape having a width W32 measured along a second direction D21 and is connected at one end to the second meander conductor part 21. The second extension part 312 and the second meander conductor part 12 are arranged on the same line. That is, a center line CL312 of the second extension part 312 and a line CL21 passing through the center of the second meander conductor part 12 become the same line.

The bend part 313 has a linear shape having a width W33 measured along the perpendicular direction to the extension direction D11, D12 of the meander conductor part 11, 21. At one end of the bend part 313, the first extension part 311 and the bend part 313 are connected roughly like the shape of a letter L. At an opposite end of the bend part 313, the second extension part 312 and the bend part 313 are connected roughly like the shape of a letter L. The first and second extension parts 311 and 312 are placed so as to extend in opposite directions when viewed from the bend part 313. Thus, the passage from the first extension part 311 through the bend part 313 to the second extension part 312 forms a crank shape.

The feeder line connection part 31*b* forms a linear shape having the same width W33 as the bend part 313. The feeder line connection part 31*b* extends along the same direction as the bend part 313 from one end of the bend part 313 and arrives at the feeder line 50.

Each of the widths W31 to W33 of the first and second extension parts 311 and 312 and the bend part 313 is made wider than a line width W11, W21 of the first, second conductor part. In FIG. 4, the first and second meander conductor parts 11 and 21, the first and second extension parts 311 and 312, the bend part 313, and the feeder line connection part 31*b* are hatched in different manners, but they are formed preferably of the same material as a continuous area.

Thus, the wide conductor part 31 is made up of the extension parts 311 and 312 extending along the first and second directions D11 and D21 and the bend part 313 and the feeder line connection part 31*b* extending in the perpendicular direction (Y direction) to the directions D11 and D21. Particularly, the wide passage from first conductor part 11 to the feeder line 50 is made up of the first extension part 311, the bend part 313, and the feeder line connection part 31*b*. Here, let the distance measured along the center line CL311 of the first extension part 311 from a center line CL313 of the bend part 313 to the connection position C11 of the first meander conductor part 11 and the first extension part 311 be L11. Let the distance measured along the center line CL313 of the bend part 313 from the intersection point of the center lines CL311 and CL313 of the first extension part 311 and the bend part 313 to the connection position to the feeder line 50 be L12. Then, the length L11, L12 is adjusted, whereby the length of the wide conductor part from the first meander conductor part 11 to the connection position to the feeder line 50 can be adjusted. Thus, the lengths L11 an L12 are adjusted, whereby impedance adjustment (reflection coefficient adjustment) in the first frequency band with which the first meander conductor part 11 operates can be made easily. Further, the length L11 in the first direction D11 is adjusted, whereby impedance adjustment can be made without enlarging the antenna itself in the perpendicular direction to the first direction D11. The length L12 in the perpendicular direction to the first direction D11 is adjusted, whereby impedance adjustment can be made without enlarging the antenna itself in the first direction D11. Further, since the lengths L11 and L12 are independent of the length of the wide conductor part from the second meander conductor part 21 to the feeder part, the lengths L11 and L12 can be adjusted without largely affecting the impedance in the frequency band of a signal transmitted and received by the second meander conductor part 21.

For the second meander conductor part 21, likewise, impedance adjustment can be made easily. Let the distance measured along the center line CL312 of the second extension part 312 from the center line CL313 of the bend part 313 to the connection position C21 to the second meander conductor part 12 be L21. Let the distance measured along the center line CL313 of the bend part 313 from the intersection point of the center lines CL312 and CL313 of the second extension part 312 and the bend part 313 to the connection position to the feeder line 50 be L22. Then, the lengths L21 and L22 are adjusted, whereby impedance adjustment in the second frequency band can be made easily without largely affecting the impedance in the first frequency band. The length L21 of the wide conductor part 31 measured along the second direction D21 is adjusted, whereby upsizing of the antenna itself in the perpendicular direction to the second direction D21 can be suppressed. The length L22 of the wide conductor part 31 in the perpendicular direction to the second direction D21 is adjusted, whereby upsizing of the antenna itself in the second direction D21 can be suppressed.

Thus, in the antenna 110 of the second embodiment, the wide conductor part 31 has a crank shape, so that the length of the wide conductor part 31 for making impedance adjustment can be adjusted in any direction of the direction along the first, second direction D11, D21 or the perpendicular direction thereto. Thus, if a different limitation is imposed on the size of the installation location of the antenna depending on the direction, the size of the antenna can be matched with the installation location and impedance adjustment of the antenna can be made easily and appropriately.

If the boundary between the antenna 110 and the feeder line 50 is not clear, the lengths L12 and L22 may be defined from any desired position on the feeder line. Also in this case, the lengths L12 and L22 are adjusted, whereby impedance adjustment can be made.

The widths W31 to W33 of the parts of the wide conductor part 31 may be set to different values; for example, the width W31 of the portion connected to the first meander conductor part 11 and whole width W11A of the first meander conductor part 11 may be made the same. The width W32 of the portion connected to the second meander conductor part 21 and whole width W21A of the second meander conductor part 21 may be made the same. However, preferably the widths W31 to W33 are set to the same value from the point of capability of suppressing signal reflection at a width change position. In any case, each of the widths W31 to W33 is made wider than the width W11, W21 of the linear line of the first, second meander conductor part 11, 21, whereby impedance adjustment in each frequency band can be made easily.

In the antenna 110 of the embodiment, the first and second meander conductor parts 11 and 21 are formed so that they are not positioned in the perpendicular direction to the extension direction of the meander conductor parts. Thus, the electromagnetic interaction between the meander conductor parts 11 and 21 can be suppressed and degradation of the characteristic of the antenna can be suppressed.

A3. Third Embodiment

Figure 5:
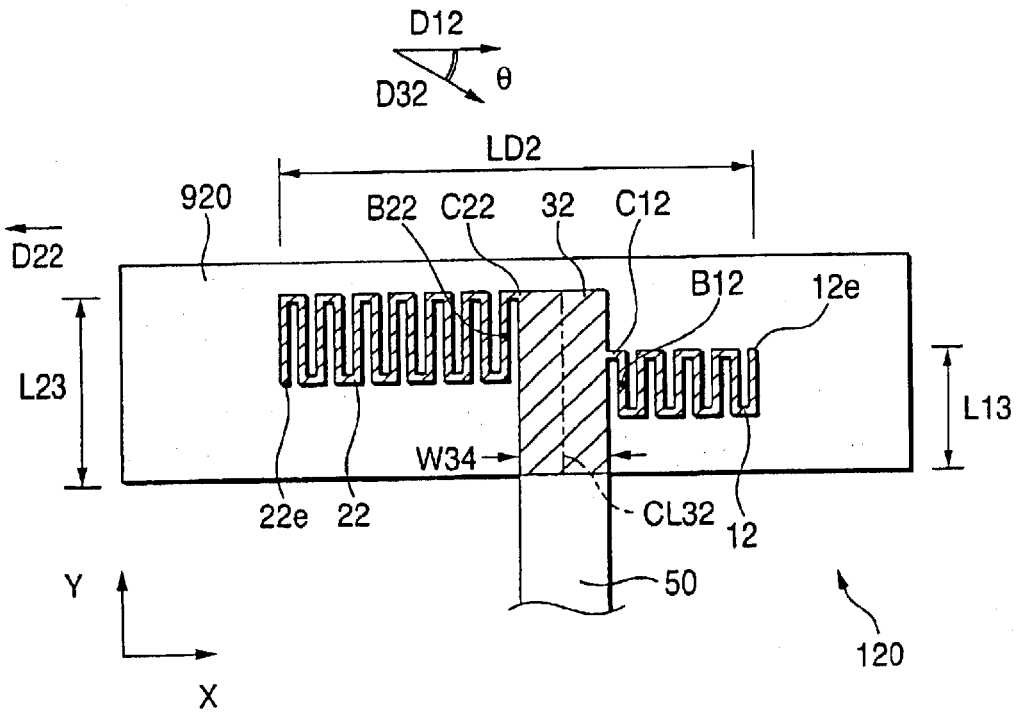
FIG. 5 is a plan view to show an antenna 120 as a third embodiment of the invention.

FIG. 5 is a plan view to show an antenna 120 as a third embodiment of the invention. The antenna 120 differs from the antenna 110 of the second embodiment previously described with reference to FIG. 4 in that a wide conductor part 32 is formed only of a linear line extending along a direction perpendicular to a first direction D12. The wide conductor part 32 is connected at one end to a feeder line 50 and is extended linearly along the perpendicular direction (Y direction) to direction D12, D22 of a first meander conductor part 12, a second meander conductor part 22. Further, the wide conductor part 32 and the first meander conductor part 12 are connected roughly like the shape of a letter T at a connection position C12 at an intermediate point of the wide conductor part 32 extended linearly. At an opposite end of the wide conductor part 32, the wide conductor part 32 and the second meander conductor part 22 are connected roughly like the shape of a letter L. The first and second meander conductor parts 12 and 22 are connected to the wide conductor part 32 so as to extend in opposite directions when viewed from the wide conductor part 32.

In the embodiment, the connection position C12 of the first meander conductor part 12 and the wide conductor part 32 is adjusted, whereby impedance adjustment in a first frequency band can be made. Let the distance measured along a center line CL32 of the wide conductor part 32 from the connection position C12 to the connection position to the feeder line 50 be L13. Then, the length L13 is adjusted, whereby the length of the wide conductor part from the first meander conductor part 12 to the feeder line 50 can be adjusted. Thus, the length L13 is adjusted, whereby impedance adjustment (reflection coefficient adjustment) in the first frequency band can be made easily. Further, the length L13 in the perpendicular direction to the first direction D12 is adjusted, whereby impedance adjustment can be made without upsizing the antenna in the first direction D12. Since the length L13 is independent of the length of the wide conductor part from the second meander conductor part 22 to the feeder line 50, the length L13 can be adjusted without largely affecting the impedance in a second frequency band.

For the second meander conductor part 22, likewise, impedance adjustment can be made easily. Let the distance measured along the center line CL32 of the wide conductor part 32 from a connection position C22 of the second meander conductor part 22 and the wide conductor part 32 to the connection position to the feeder line 50 be L23. Then, the length L23, namely, the length of the wide conductor part 32 is adjusted, whereby impedance adjustment in the second frequency band can be made easily without largely affecting the impedance in the first frequency band.

Thus, in the antenna 120 of the embodiment, the length L13, L23 of the wide conductor part 32 for making impedance adjustment can be adjusted along the perpendicular direction to the first direction D12. Thus, while upsizing of the antenna itself measured along the first direction D12 is suppressed, the impedance can be adjusted.

A4. Fourth Embodiment

Figure 6:
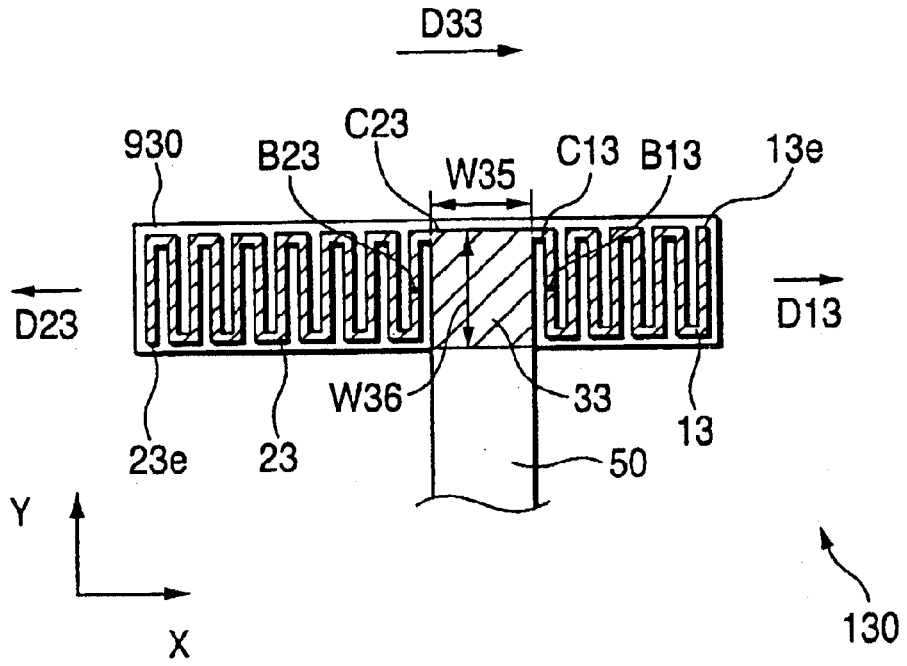
FIG. 6 is a plan view to show an antenna 130 as a fourth embodiment of the invention.

FIG. 6 is a plan view to show an antenna 130 as a fourth embodiment of the invention. The antenna 130 differs from the antenna 100 of the first embodiment previously described with reference to FIG. 1 or the antenna 120 of the third embodiment previously described with reference to FIG. 5 in that the antenna 130 is formed so that a width W35 of a wide conductor part 33 measured along a first direction D13 and a width W36 measured along a perpendicular direction (Y direction) to the first direction D13 are substantially the same. In such a case, preferably the width W35 measured along the first direction D13 or the width W36 measured along the Y direction, whichever is narrower, is made wider than the width of a linear line of a first conductor part 13, a second conductor part 23. In doing so, the antenna itself can be downsized and impedance adjustment can be made easily.

Figure 7A:
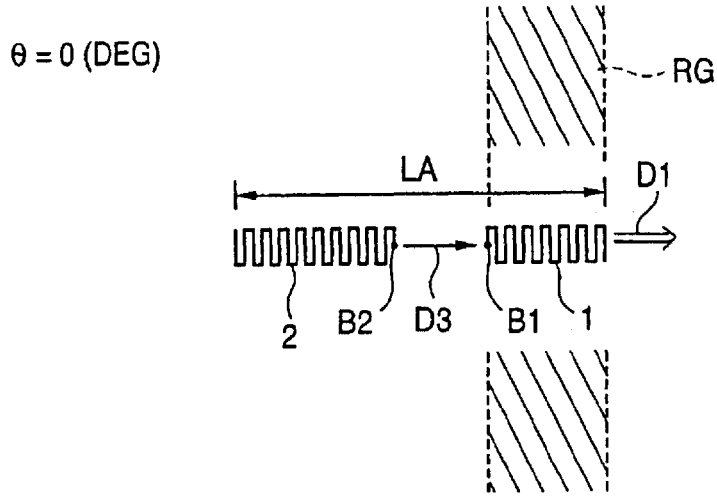
FIGS. 7A to 7C are schematic representations to describe the relationship between a first angle θ and placement of first and second conductor parts.
Figure 7B:
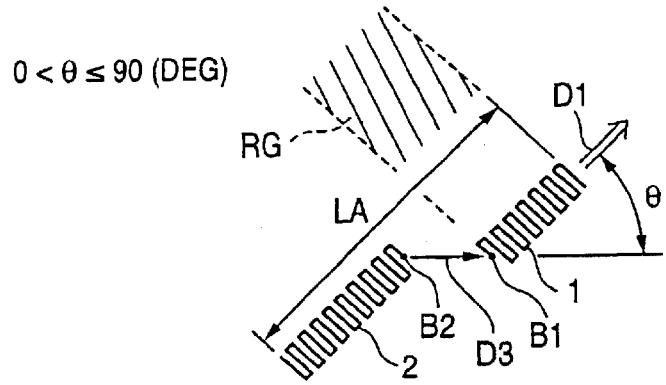
Figure 7C:
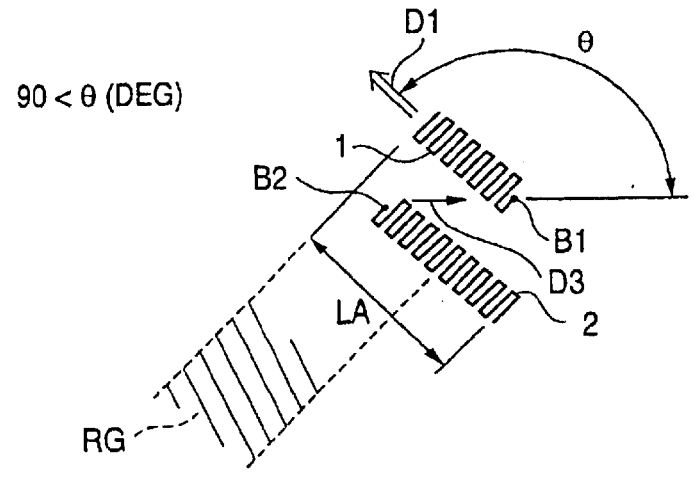

By the way, the positional relationship between the first and second meander conductor parts in each embodiment described above can also considered as follows:

FIGS. 7A to 7C are schematic representations to describe three types of placement relationships between first and second meander conductor parts 1 and 2. In the figures, the wide conductor part is not shown. The first meander conductor part 1 is formed so as to extend in the first direction D1 with a first base point B1 as the substantial start point. Likewise, the second meander conductor part 2 is formed so as to extend in the opposite direction to the first direction D1 with a second base point B2 as the substantial start point. A third direction D3 from the second base point B2 to the first base point B1 is used as an indicator indicating the placement direction of the first, second meander conductor part 1, 2. Angle θ is the angle between the first direction and the third direction and indicates the angle between a line extending in the third direction from the second base point B2 to the first base point B1 and a line extending in the first direction. In FIG. 7, the third direction D3 is indicated by a single-line arrow and the first direction D1 indicated by a double arrow. Distance LA in the figure indicates the dimension provided by measuring the whole antenna in the first direction.

FIG. 7A shows placement of the conductor parts when the angle θ between the third direction D3 and the first direction D1 (first angle) is 0 degrees, namely, the conductor parts are in the same direction. For example, the antenna 100 of the first embodiment previously described with reference to FIG. 1 and the antenna 130 of the fourth embodiment previously described with reference to FIG. 6 are applied. Thus, if the angle θ is 0 degrees, the first and second conductor parts 1 and 2 are placed on the same line. Thus, enlarging of the antenna width in the perpendicular direction to the first direction can be suppressed. Further, the first and second conductor parts 1 and 2 are placed so that they are not positioned in the perpendicular direction to the extension direction (for example, first direction), namely, not positioned in a projection area in the perpendicular direction to the first direction. In FIG. 7, an area RG of projecting the first meander conductor part 1 in the perpendicular direction to the first direction is shown. In the placement in FIG. 7A, the second meander part 2 is not positioned in the area RG. Thus, the electromagnetic interaction between the first and second conductor parts can be suppressed and degradation of the characteristic of the antenna can be suppressed.

FIG. 7B shows placement of the conductor parts when the angle θ is larger than 0 degrees and equal to or less than 90 degrees. For example, the antenna 110 of the second embodiment previously described with reference to FIG. 4 and the antenna 120 of the third embodiment previously described with reference to FIG. 5 are applied. Also in this case, the first and second conductor parts 1 and 2 are placed so that they are not positioned in the perpendicular direction to the extension direction (for example, first direction). Thus, the electromagnetic interaction between the first and second conductor parts can be suppressed. Further, the larger the angle θ, the smaller the dimension LA measured along the first direction D1, so that the size of the antenna itself measured along the first direction D1 can made small.

FIG. 7C shows placement of the conductor parts when the first angle θ is larger than 90 degrees. In this case, unlike the examples in FIGS. 7A and 7B, the first and second conductor parts 1 and 2 are placed so that they are positioned in the perpendicular direction to the extension direction (for example, first direction). For example, the second meander conductor part 2 is positioned in the area RG of projecting the first meander conductor part 1 in the perpendicular direction to the first direction. Thus, the electromagnetic interaction between the first and second conductor parts becomes larger than that in the placement in FIGS. 7A, 7B. Therefore, from the viewpoint of improving the reflection coefficient, preferably the angle θ is a value in the range of 0 to 90 degrees, most preferably about 0 degrees. However, the larger the angle θ, the smaller the dimension LA measured along the first direction, so that the placement in FIG. 7C makes it possible to make smaller the size of the antenna itself measured along the first direction as compared with the placement in FIGS. 7A, 7B.

B: Radio Frequency Module

Figure 8:
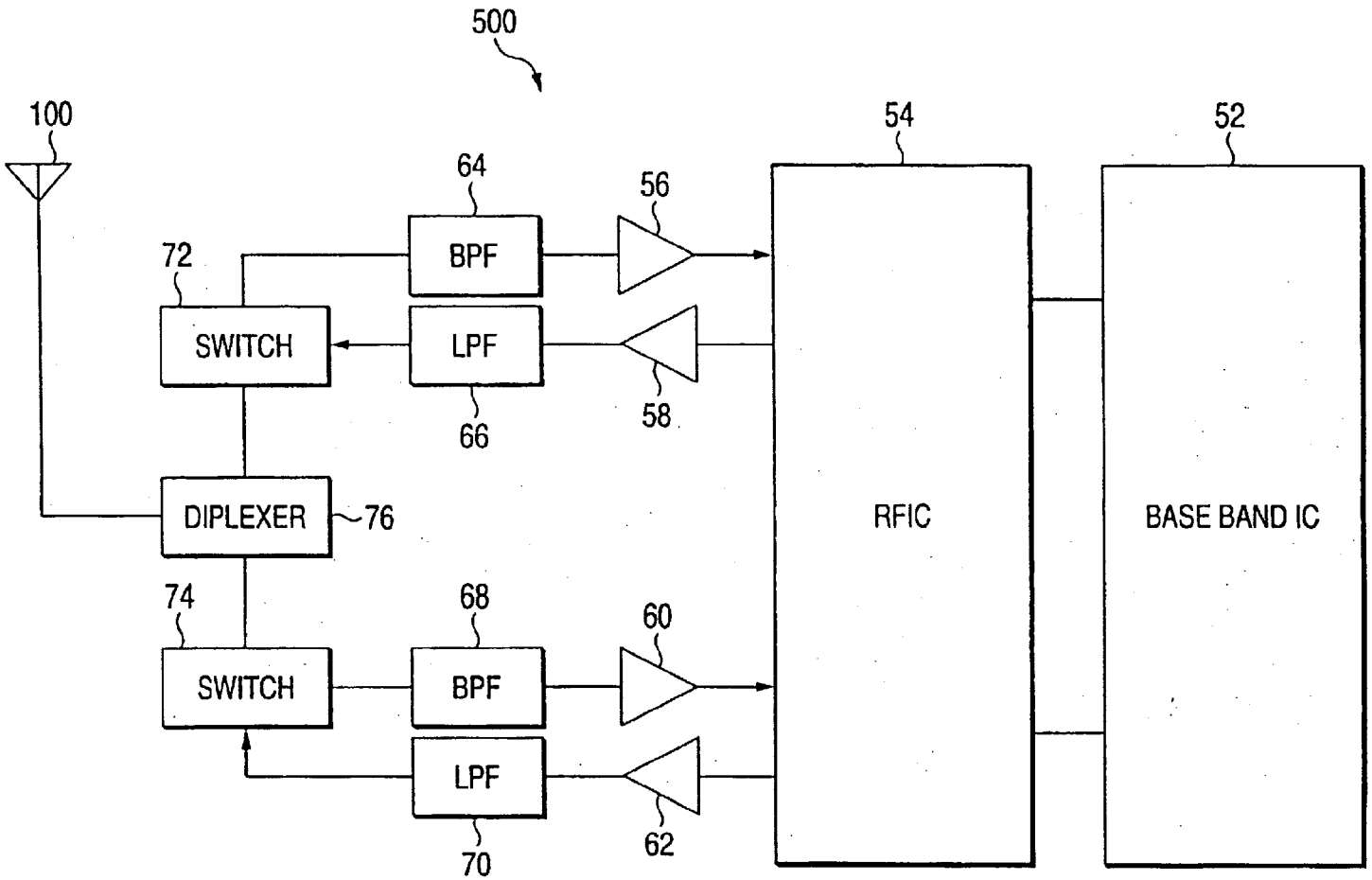
FIG. 8 is a block diagram to show the configuration of a radio frequency module incorporating the antenna 100 shown in FIG. 1.
Figure 9:
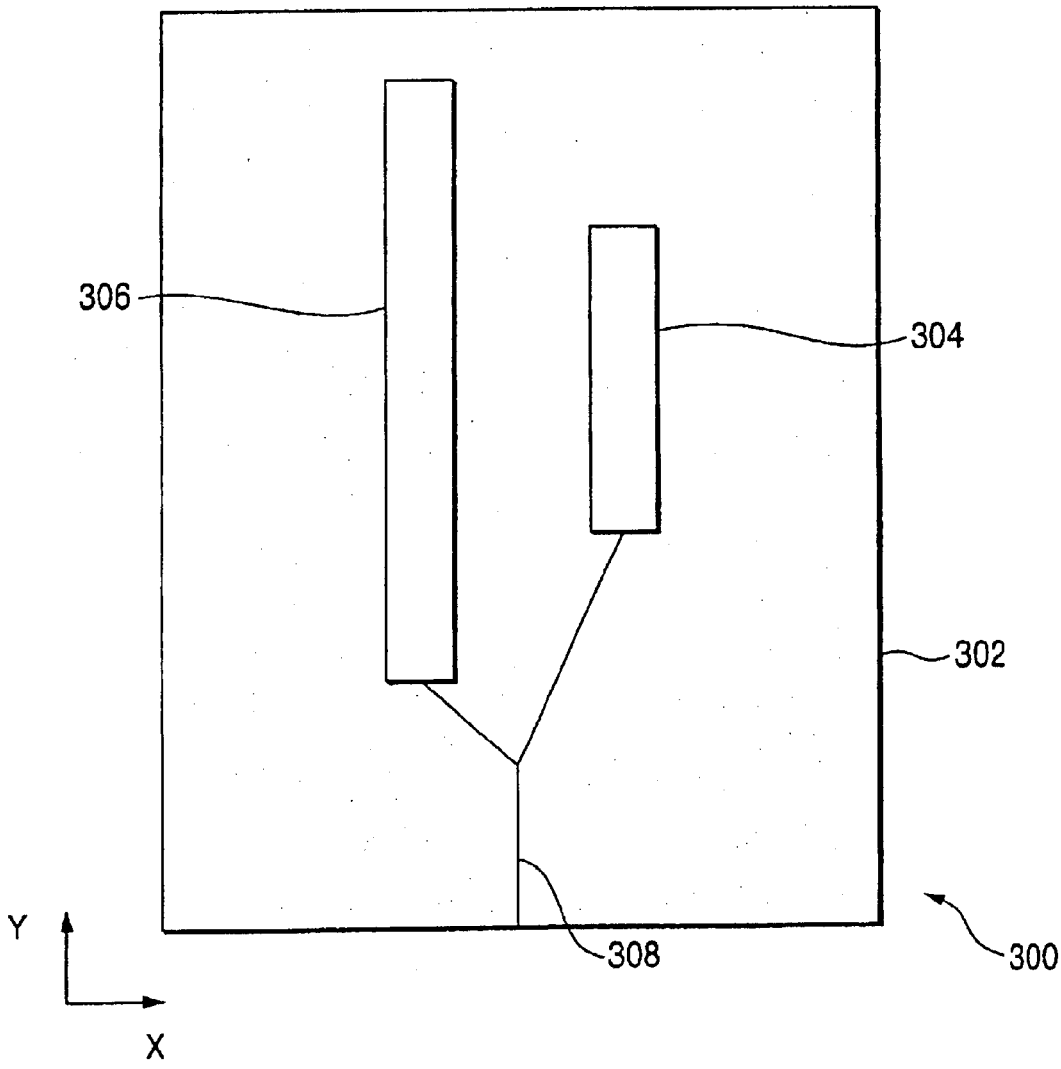
FIG. 9 is a plan view to show an example of a multi-band antenna in a related art.

The antenna 100, 110, 120, 130 in the first to third embodiments described above is installed in a radio communication device in a wireless LAN, etc., as one component of a radio frequency module, for example. FIG. 8 is a block diagram to show the configuration of a radio frequency module incorporating the antenna 100 previously described with reference to FIG. 1.

As shown in FIG. 8, a radio frequency module 500 includes a base band IC 52, a radio frequency (RF) IC 54, low-noise amplifiers 56 and 60, power amplifiers 58 and 62, band-pass filters (BPFs) 64 and 68, low-pass filters (LPFs) 66 and 70, switches 72 and 74, a diplexer 76, and the antenna 100 in FIG. 1. The low-noise amplifier 56, the power amplifier 58, the BPF 64, the LPF 66, and the switch 72 are a circuit for the 2.4-GHz band, and the low-noise amplifier 60, the power amplifier 62, the BPF 68, the LPF 70, and the switch 75 are a circuit for the 5-GHz band.

The base band IC 52 controls the RFIC 54 and transfers a low-frequency signal to and from the RPIC 54. The RFIC 54 converts a low-frequency transmission signal received from the base band IC 52 into a radio frequency signal and converts a radio frequency reception signal into a low-frequency signal and passes the low-frequency signal to the base band IC 52.

The diplexer 76 performs band switching between 2.4-GHz and 5-GHz bands. Specifically, to communicate in the 2.4-GHz band, the diplexer 76 connects the antenna 100 and the circuit for the 2.4-GHz band; to communicate in the 5-GHz band, the diplexer 76 connects the antenna 100 and the circuit for the 5-GHz band.

Each of the switches 72 and 74 switches the signal path in response to transmission or reception. Specifically, to receive a signal, the signal path on the BPF side is selected; to transmit a signal, the signal path on the LPF side is selected.

Therefore, for example, if communications are conducted in the 2.4-GHz band and the antenna 100 receives a signal, the reception signal is input through the diplexer 76 and the switch 72 to the BPF 64 and is subjected to band limitation through the BPF 64 and then the signal is amplified by the low-noise amplifier 56 and is output to the RFIC 54. The RFIC 54 converts the reception signal from the 2.4-GHz band to a low-frequency band and passes the conversion result to the base band IC 52.

In contrast, to transmit a signal through the antenna 100, a low-frequency transmission signal is passed from the base band IC 52 to the RFIC 54, which then converts the transmission signal from a low-frequency band to the 2.4-GHz band. The transmission signal is amplified by the power amplifier 58 and then the low-frequency band is cut through the LPF 66 and then the signal is transmitted from the antenna 100 through the switch 72 and the diplexer 76.

On the other hand, to communicate in the 5-GHz band, using the circuit for the 5-GHz band, processing involved in transmission and reception is performed according to a similar procedure to that of communications in the 2.4-GHz band, and a signal is transmitted and received using the same antenna 100 as used in the 2.4-GHz band.

It is to be understood that the invention is not limited to the specific embodiments thereof and various embodiments of the invention may be made without departing from the spirit and scope thereof. For example, the following modifications are also possible:

C. Modifications

C1. First Modification

In the above-described embodiments, antenna-dedicated substrates are used as the dielectric substrates 900, 910, 920, and 930, but print circuit boards for mounting parts may be used in place of the dedicated substrates. For example, to apply the antenna of the invention to a radio frequency module as shown in FIG. 8, the antenna elements making up the antenna of the invention may be formed in a partial area of the print circuit board on which a part or all of the radio frequency module is constructed C2. Second Modification In the above-described embodiments, the linear lines of the first and second conductor parts are periodically repetitive patterns of rectangular wave shape, but the pattern is not limited to the rectangular wave shape and generally, various repetitive patterns of peaks and valleys can be used. For example, the turn portion of the linear line in the perpendicular direction to the extension direction of the first, second conductor part may be formed using a linear line having a semicircle. The pattern may be a waveform repetitive pattern of a sin function, etc. In any case, if the pattern is a pattern such that a linear line repetitively crosses the center line of the first, second conductor part, the length of the linear line can be lengthened as compared with the length occupied by the pattern, so that the antenna itself can be downsized.

C3. Third Modification

In the above-described embodiments, the wide conductor part connecting the first and second meander conductor parts is formed so as to extend in the perpendicular or parallel direction to the direction of the center line of the meander conductor part. Alternatively, the wide conductor part may be formed so as to extend in a slanting direction relative to the direction of the center line of the meander conductor part. Also in this case, the narrowest width in the linear line connecting the first and second meander conductor parts is made wider than the width of the linear line of the first, second meander conductor part, whereby the antenna itself can be downsized and impedance adjustment can be made easily.

C4. Fourth Embodiment

In the embodiments, the case where the antenna is used with a radio communication device in a wireless LAN, etc., is described, but the antenna may be used with a radio communication device in a mobile telephone, Bluetooth, etc.

This application is based on Japanese Patent application JP 2002-350735, filed Dec. 3, 2002, the entire content of which is hereby incorporated by reference, the same as if set forth at length.

What is claimed is:

1. A multiple band antenna comprising:

a dielectric substrate; and a plurality of conductor parts formed on a face of the dielectric substrate and connected to each other, wherein the plurality of conductor parts comprises:

a first conductor part forming a first antenna operating in a first operating frequency band and extending in a first direction with a repetitive pattern of peaks and valleys of a linear line and arriving at an open end;

a second conductor part forming a second antenna operating in a second, different operating frequency band and extending in a second direction substantially opposite to the first direction with a repetitive pattern of peaks and valleys of a linear line and arriving at an open end; and a third conductor part which provides individual impedance matching for said first and second antennas, said third conductor being formed of a wide line having a wider width than that of each of the linear lines of the first and second conductor parts and being connected to opposite ends of the first and second conductor parts and also connected to a feeder line.

2. The multiple band antenna according to claim 1, which operates with two frequency bands of a 2.4-GHz band and a 5-GHz band.

3. A radio frequency module for transmitting and receiving a signal, comprising the multiple band antenna according to claim 1.

4. The multiple band antenna according to claim 1, wherein a line connecting a connection position of the first and third conductor parts and a connection position of the second and third conductor parts and a line passing through a center of the peaks and valleys and extending in the first direction in the first conductor part are not parallel.

5. A radio frequency module for transmitting and receiving a signal, comprising the multiple band antenna according to claim 4.

6. The multiple band antenna according to claim 1, wherein when a point nearest to a connection position to the third conductor part, of points at which a line passing through a center of the peaks and valleys and extending in the first direction and the linear line in the first conductor part cross each other is a first base point, and when a point nearest to a connection position to the third conductor part, of points at which a line passing through a center of the peaks and valleys and extending in the second direction and the linear line in the second conductor part cross each other is a second base point, a first angle between a line extending in a third direction from the second base point to the first base point and a line extending in the first direction is 90 degrees or less.

7. The multiple band antenna according to claim 1, wherein the dielectric substrate is a print circuit board for mounting parts.

8. The multiple band antenna according to claim 7, wherein the print circuit board mounts parts for a radio communication device.

9. A radio frequency module for transmitting and receiving a signal, comprising the multiple band antenna according to claim 1.

10. The radio frequency module according to claim 9, which further comprises a switch for switching a signal path in response to transmission or reception.

* * * * *